United States Patent [19]

Reuter

[11] 4,327,789

[45] May 4, 1982

[54] METHOD AND APPARATUS FOR THE CHIPPING DISSECTION OF TREE LOGS INTO ALL-ROUND MACHINED LUMBER PRODUCTS

[75] Inventor: Alfred Reuter, Oberkirch, Fed. Rep. of Germany

[73] Assignee: Gebruder Linck, Maschinenfabrik und Eisengiesserei "Gatterlinck", Oberkirch, Fed. Rep. of Germany

[21] Appl. No.: 140,840

[22] Filed: Apr. 16, 1980

[30] Foreign Application Priority Data

Jul. 18, 1979 [DE] Fed. Rep. of Germany ..... 2928949

[51] Int. Cl.[3] ..... B27C 1/08

[52] U.S. Cl. ..... 144/326 R; 144/39; 144/312; 144/3 R; 198/344

[58] Field of Search ..... 198/344, 379; 144/312, 144/1 R, 3 R, 3 P, 37, 39, 41, 242 R, 246 R, 326 R, 39

[56] References Cited

U.S. PATENT DOCUMENTS

| | | | |
|---|---|---|---|
| 3,259,157 | 7/1966 | Runnion | 144/312 |
| 3,457,978 | 7/1969 | Ahlstedt | 144/312 |
| 3,487,866 | 1/1970 | Mitten | 144/41 |
| 3,738,404 | 6/1973 | Walker | 144/39 |
| 3,920,058 | 11/1975 | Walker | 144/312 |
| 3,934,630 | 1/1976 | Cockle | 144/312 |

*Primary Examiner*—W. D. Bray

*Attorney, Agent, or Firm*—Schmidt, Johnson, Hovey & Williams

[57] ABSTRACT

An improved method and apparatus for processing elongated logs to give maximum production of lumber is described wherein the log is initially cut to present four flattened faces thereon with wany edge regions between adjacent faces, followed by first partially milling the wany edge regions with severance of boards from opposed log faces, and thereafter completing the milling of the wany edge regions with subsequent removal of additional finished boards. Such stepwise partial milling of the wany edge regions materially increases the amount of lumber obtainable from a given log, as compared with prior practices. In preferred forms, the log is processed in an improved apparatus including log turning stations having a pair of pivotally mounted, opposed log-gripping arms; the respective arms are supported on a circular frame which is itself rotatable about the longitudinal axis of the log.

8 Claims, 6 Drawing Figures

Figure 1:
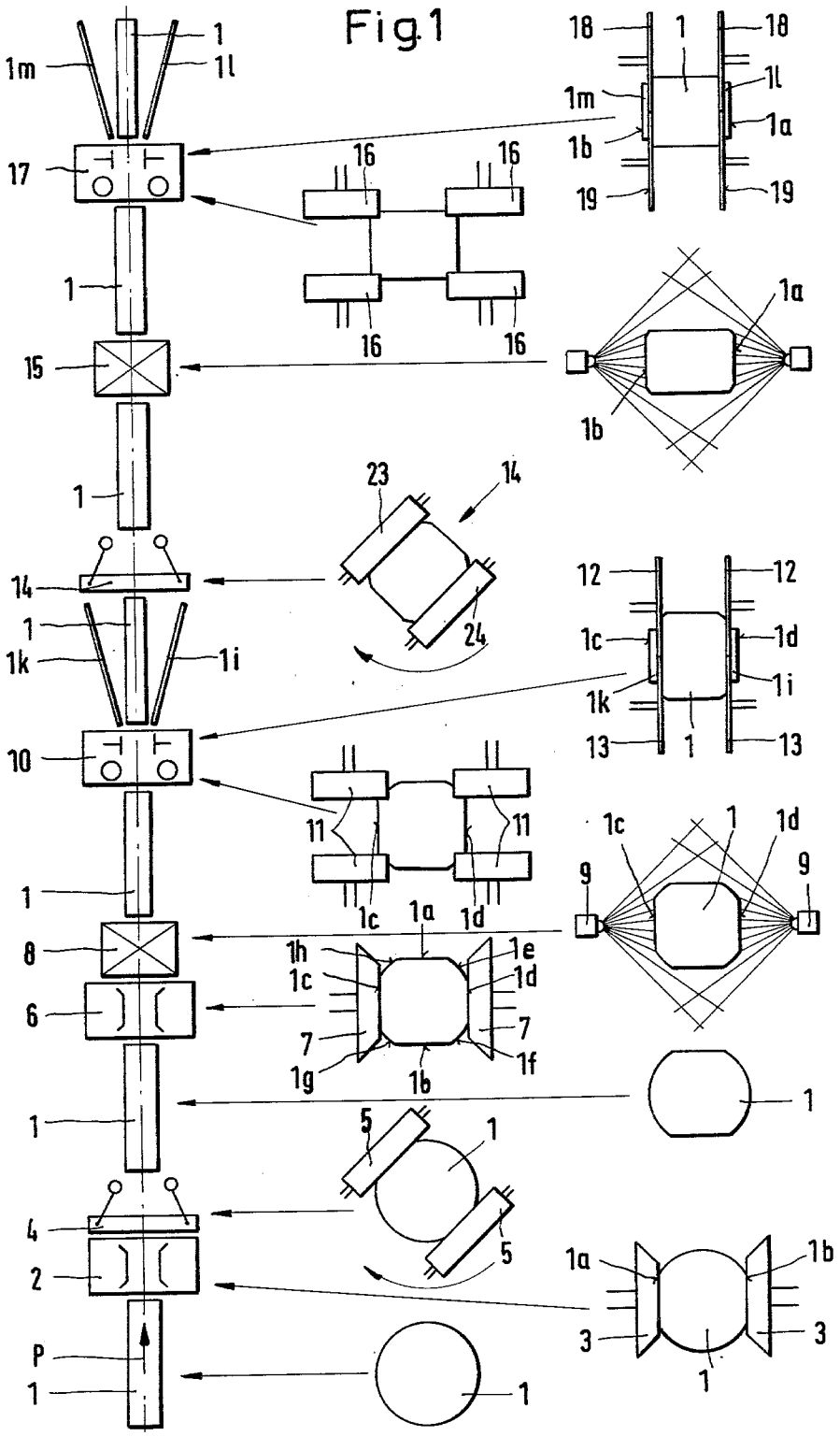

1
1m
1l
17
16
16
16
16
1
15
1a
1b
1
23
14
14
24
12
12
1
1c
1d
1k
1i
1k
1i
10
13
1
13
11
11
1c
1a
1d
1c
1
1d
9
9
1
8
1h
1e
1c
1d
6
7
7
1g
1b
1f
1
1
5
1
4
5
2
1a
1b
3
3
1
P
1
1

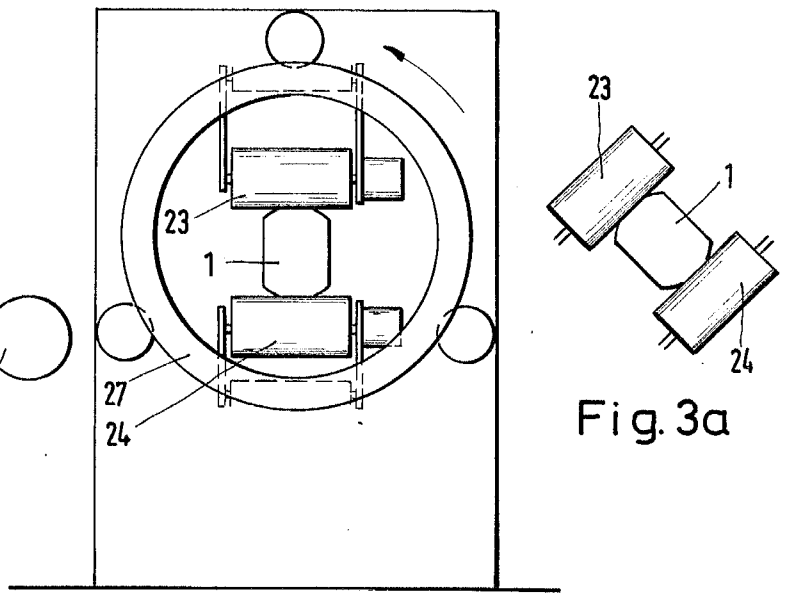
Fig.3a
Fig.3
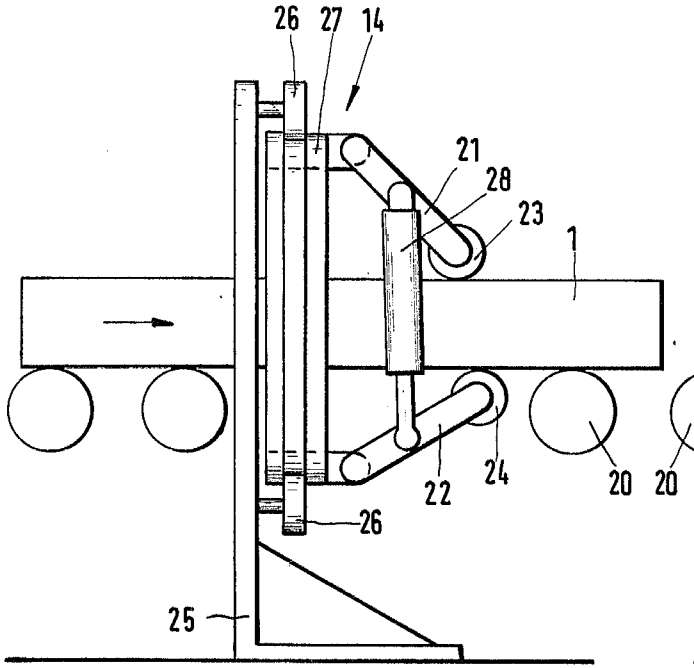
Fig.2

METHOD AND APPARATUS FOR THE CHIPPING DISSECTION OF TREE LOGS INTO ALL-ROUND MACHINED LUMBER PRODUCTS

The present invention relates to a method for the chiping dissection of tree logs into all-round machined lumber products, such as boards and squared timber, in which the logs are flattened on four sides, the remaining wany edges are milled out at right angles, and lateral boards are separated by saw cuts on at least two opposite sides.

Close approach to the initial round tree cross-section—i.e. maximum utilization of the lumber in the tree log—can be achieved by cutting the log by means of vertical saw cuts into wany edged boards of varying width, which are then edged. In this process, however, each board must be individually edged, which makes for a fairly demanding operation, particularly if extensive automation of the edging process is desired.

It is well known that, before sawing tree logs into boards such as squared timber, they must be prepared by flattening the four sides and right-angle milling of the remaining wany edges is required. Then, lateral boards are cut off from opposite sides by a vertical saw cut, each. The remaining portion of the tree log having a rectangular cross-section should—if possible—no longer have any wany edges, i.e. bark attached to its edges; it can then be sawed into planks such as squared timber.

While this familiar procedure permits extensive automation, it does not insure optimum lumber utilization since either the flattening of the upper and lower faces will be very wasteful or one will have to tolerate that wany edges still remain on the tree log, so that, even after the lateral boards have been separated, it will still be necessary to edge some of the boards obtained subsequently.

The object of the present invention, therefore, is to design the above process in such a manner that, despite extensive automation, maximum lumber yield is achieved, i.e. that as much of the original cross-section of the tree log is utilized as possible.

This object is achieved by the following sequence of operational steps. In accordance with the invention two opposite sides of the tree log are cut to produce flat faces, the tree log is turned 90° about its longitudinal axis, the other two opposite sides of the log are cut to produce flat faces, the four remaining wany edges are partially milled out, each of the two lateral boards located between an upper and a lower milled-out edge of the tree log, is cut off by at least one vertical saw cut, the tree log is turned 90° about its longitudinal axis, the four residual wany edges are completely milled out, each of the two lateral boards located between an upper and a lower milled-out edge of the tree log, is cut off by at least one vertical saw cut.

Turning the tree log twice, provides the possibility of cutting lateral boards from all four sides of the log, thus insuring fuller utilization of the lumber, said lateral boards being preprocessed in such a manner by the prior milling out of the tree log edges that they no longer present any wany edges and do not require further edging. Thus, the process of the invention achieves a compromise between two mutually contradictory requirements, maximum utilization of the lumber on the one hand, and efficient automation of the operation on the other.

According to a modified embodiment of the invention between operational steps (c) and (d), or between these operational steps and operational steps (f) and (g), respectively, the opposite lateral faces are measured and the height of the cutting tools is set accordingly for the milling out of the wany edges.

The invention concerns also an advantageous apparatus for implementing the rotation operations required by the process defined by the invention.

Figure 4:
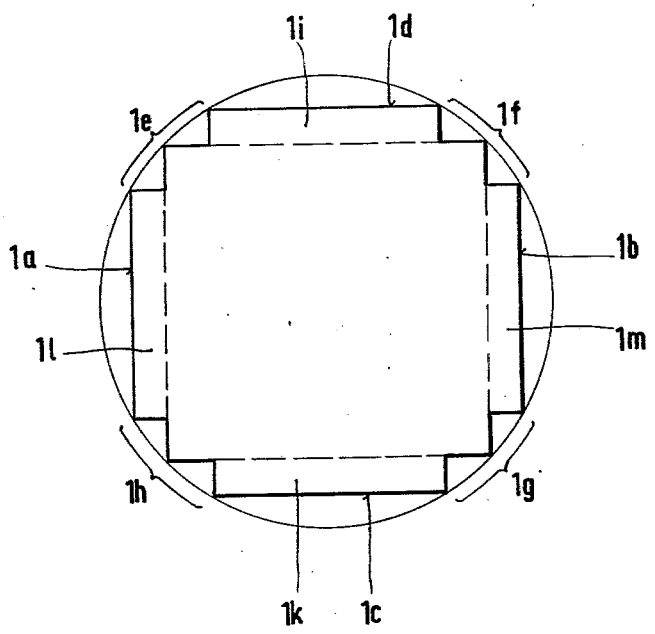
Figure 5:
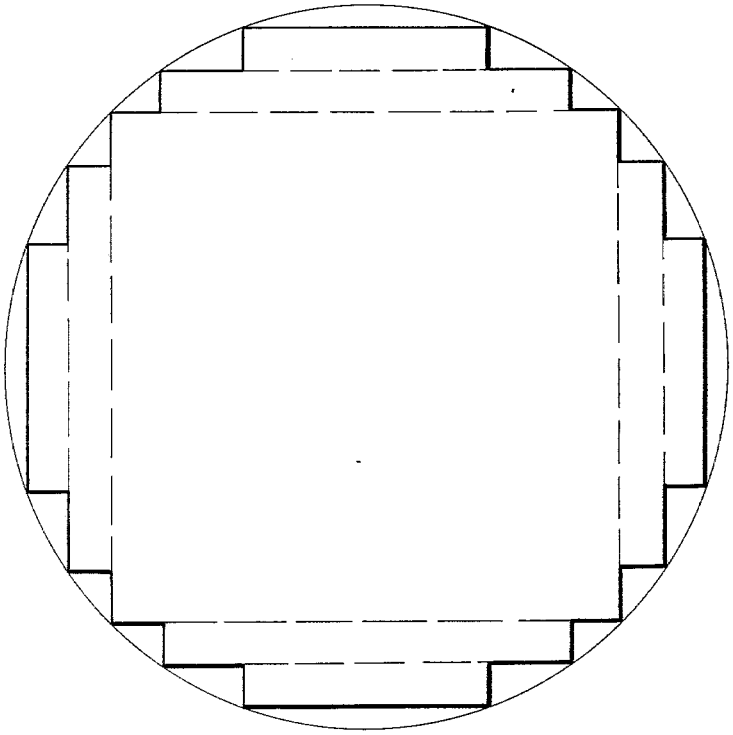

The invention is described in greater detail by the embodiment presented here by way of example and illustrated in the drawings, showing in:

FIG. 1 in simplified form a top view of an installation for the full automation of all phases of tree log processing, FIG. 2 a simplified side elevation of the log turning means used in the installation represented by FIG. 1, FIG. 3 a front view of the turning means represented by FIG. 2, FIG. 3*a* a partial view, corresponding to FIG. 3, of an intermediate position during the turning operation, FIG. 4 the cross-section of a tree log, showing the sequence of processing steps defined by the invention, FIG. 5 the cross-section of a tree log, as in FIG. 4, illustrating a modified sequence of operational steps in which two lateral boards are cut from each side of the log.

Tree log 1 advanced along a straight line, in the direction of arrow P, through the installation shown in the left half of FIG. 1, i.e. from bottom to top of the drawing. The processing step performed at each individual station of the installation and the resulting cross-section of the tree log are shown beside the corresponding station.

First, two lateral faces 1*a* and 1*b* are cut in the tree log in profile cutter 2 by means of cutter heads 3. Then, log 1 is seized by gripper rollers 5 and turned 90° about its longitudinal axis.

Log advancing conveyor means, not represented in FIG. 1, which traverse the entire installation, then feed log 1 to cutter heads 7 of second profile cutter 6, where the other opposing two faces 1*c* and 1*d* are milled into log 1. Wany edges 1*e*, 1*f*, 1*g* and 1*h* are left between lateral faces 1*a*, 1*d*, 1*b* and 1*c*, respectively.

Log 1, which now presents flat faces on its four sides, is then fed to measuring station 8, where lateral face areas 1*c* and 1*d* are measured. The measuring devices are also merely indicated in FIG. 1; they may, for example, be constituted by scanning cameras.

Subsequent processing station 10 features cutter heads 11 rotating on vertical axes, which partially mill out wany edges 1*e*, 1*f*, 1*g* and 1*h*. The height at which these cutter heads 11 are set, is a function of the measurement effected by measuring device 9, and is such as to leave no bark on lateral faces 1*d* and 1*c*. Immediately thereafter, double circular saws 12 and 13, mounted on horizontal axes in processing station 10, cut off lateral boards 1*i* and 1*k* from lateral faces 1*d* and 1*c*, respectively. Thereupon, tree log 1 is turned 90° about its longitudinal axis by turning means 14, similar in design to turning means 4. In this position, lateral faces 1*a* and 1*b* are measured at measuring station 15, similar in design to measuring station 8.

The measurement thus obtained determines the height of cutter heads 16 which serve to mill out any residual wany surface on edges 1*e*, 1*f*, 1*g* and 1*h* in processing station 17, similar in design to processing station 10, which also comprises two pairs of circular saws 18, 19 mounted on horizontal axes, by means of which lateral boards 1*l* and 1*m* are cut from lateral faces 1*a* and 1*b*, respectively.

Measuring station 15 may actually be dispensed with, in which case measuring station 8 must provide measurements for all the lateral faces. In such an installation, the measurements obtained at measuring station 8 determine not only the height of cutter heads 11, as described, but also that of cutter heads 16.

FIGS. 2, 3 and 3*a* show turning means 14, whose design is similar to that of turning means 4.

Tree log 1 is advanced by motor-driven roller conveyor 20. As soon as tree log 1 reaches turning means 14, it is seized on two opposite lateral faces by motor-driven rollers 23, 24 mounted on gripper arms 21, 22. Said gripper arms 21, 22 pivot on frame 27 which rotates in machine structure 25 by means of guide rollers 26. Said gripper arms 21, 22 are connected by means of pressure-operated piston-cylinder unit 28. Said piston-cylinder unit 28 forces rollers 23, 24 against log 1 while a motor (not shown) rotates frame 27 so as to turn log 1 90° about its longitudinal axis. Thereupon, log 1 is released by rollers 23, 24.

FIG. 3*a* shows an intermediate position with respect to FIG. 3 in the course of the rotation process.

FIG. 4 demonstrates that the original circular cross-section of the tree log is largely utilized by cutting the four boards 1*i*, 1*k*, 1*l* and 1*m* from its flanks, leaving a square cross-section for a squared timber which can, in turn, be sawed into boards, squared timbers, etc.

The diagram of FIG. 5, similar to that of FIG. 4, shows that it is also possible to cut more than one lateral board from each of the four lateral faces, e.g. two lateral boards, each, as in this example. The cross-section diagram shows that cutter heads 11 and 16 do not just mill out simple right-angle steps from the wany edges, but rather a double step, each, since the outermost lateral board is narrower than the next one located closer to the center.

It can further be seen in FIG. 5 that this more pronounced gradation makes possible even better utilization of the lumber, i.e. a utilized cross-section that is an even closer approximation of the total circular cross-section of the tree log.

This sectioning of the tree log, as shown in FIG. 5, is particularly well suited for larger tree logs with diameters of about 25 to 40 cm. For the purpose of milling out of the edges, cutter heads 11 and 16 can either be designed as stepped cutter heads, or two cutters can be placed staggered, one behind the other. The outermost boards are cut off by means of circular saws 12, 13 or 18, 19, while the inner lateral board is best sawed off by band saws owing to its greater depth.

I claim:

1. In a method of processing an elongated log to produce boards therefrom including the steps of cutting said log to present four flattened faces thereon with wany edge regions between adjacent faces, said faces being arranged in pairs with the faces of each pair being generally opposed, milling said wany edge regions, and severing boards from the log at the areas of said milling, the improvement which comprises initially milling only a part of said wany edge regions, severing first boards from one pair of said opposed, flattened faces of the log and at the areas of said initial milling, and subsequently milling the remainder of said wany edge regions and severing second boards from the other pair of said opposed flattened faces of the log at the areas of said subsequent milling.

2. The method as set forth in claim 1, including the step of axially rotating said log after said severing of said first boards.

3. The method as set forth in claim 1, said initial and subsequent millings each being substantially right angle millings.

4. The method as set forth in claim 1, including the steps of measuring said log prior to each of said initial and subsequent milling steps, and carrying out the respective milling steps at a location and to a depth determined as a result of said measurements.

5. In log handling apparatus for receiving and handling an elongated log during processing thereof, said log presenting a pair of opposed spaces, including means for advancing the log along a path of travel, the improvement which comprises a log turning assembly, said assembly comprising a pair of generally opposed log-engaging arms respectively located adjacent said path of travel for gripping engagement with said opposed faces of said log;

frame structure;

means pivotally coupling said arms to said frame structure for movement of arms toward and away from said log; and means mounting said frame structure for rotation thereof substantially about the longitudinal axis of said log.

6. Apparatus as set forth in claim 5, each of said arms including a powered, log-engaging roller.

7. Apparatus as set forth in claim 5, including a pressurized fluid piston and cylinder assembly operatively coupled between said arms.

8. Apparatus as set forth in claim 5, said frame structure comprising a circular rim, said frame mounting means comprising three spaced roller means.

* * * * *